United States Patent [19]

Cook, deceased et al.

[11] 4,152,474

[45] May 1, 1979

[54] ACOUSTIC ABSORBER AND METHOD FOR ABSORBING SOUND

[75] Inventors: John R. Cook, deceased, late of Riegelsville, Pa.; by Warren C. Cook, executor, Shaftsbury; by First Vermont Bank and Trust Co., executor, Bennington, both of Vt.

[73] Assignee: Chemical Fabrics Corporation, North Bennington, Vt.

[21] Appl. No.: 898,947

[22] Filed: Apr. 21, 1978

Related U.S. Application Data

[63] Continuation of Ser. No. 727,351, Sep. 28, 1976, abandoned, which is a continuation-in-part of Ser. No. 627,799, Oct. 31, 1975, abandoned.

[51] Int. Cl.[2] ..... E04B 1/74; E04B 1/99; B32B 3/10

[52] U.S. Cl. ..... 428/137; 156/71; 181/291; 428/246; 428/251; 428/284; 428/285; 428/286; 428/332; 428/340; 428/422

[58] Field of Search ..... 181/286, 288, 290–296; 52/729; 428/137, 245, 246, 251, 255, 260, 262, 267, 268, 284, 285, 286, 332, 340, 422; 156/71

[56] References Cited

U.S. PATENT DOCUMENTS

| | | | |
|---|---|---|---|
| 2,071,865 | 2/1937 | Parsons | 52/729 |
| 2,907,677 | 10/1959 | Hochberg | 428/268 |
| 3,844,875 | 10/1974 | Chamberlain | 428/137 |
| 3,954,540 | 5/1976 | Chamberlain | 428/137 |
| 3,966,013 | 6/1976 | Hatch et al. | 428/257 |
| 3,966,522 | 6/1976 | Hatch et al. | 428/257 |
| 3,968,297 | 7/1976 | Sauer | 428/268 |
| 3,977,492 | 8/1976 | Hankel | 181/292 |
| 3,994,363 | 11/1976 | Hiras et al. | 181/286 |

OTHER PUBLICATIONS 2,263,700 Offenlegungschrift, (7–1974), W. Germany, 1 sht. dwg., 7 pp. spec.

*Primary Examiner*—William J. Van Balen
*Attorney, Agent, or Firm*—Brumbaugh, Graves, Donohue & Raymond

[57] ABSTRACT

An acoustic absorber and a method for absorbing sound utilize a substrate having a plurality of openings therethrough. An organic polymer coating covers the substrate and partially fills the openings in the substrate to form an acoustic absorber having a porosity not greater than 60 CFM/ft$^2$.

11 Claims, No Drawings

ACOUSTIC ABSORBER AND METHOD FOR ABSORBING SOUND

This is a continuation of application Ser. No. 727,351 filed Sept. 28, 1976, now abandoned, which is a continuation-in-part of application Ser. No. 627,799 filed Oct. 31, 1975, now abandoned.

The present invention relates essentially to an acoustic absorber and a method for absorbing sound, and, more particularly, to a new and improved acoustic absorber which may be employed to reduce noise levels and reverberations in rooms, convention centers, auditoriums, enclosed stadiums, manufacturing areas and subways and to attenuate sound in longitudinal sound paths, such as ducts and corridors.

Acoustic energy, i.e., sound, may be absorbed by any medium which is capable of converting incident sound waves into other forms of energy and ultimately to heat. Most building materials possess sound-absorbing qualities, but those specifically designed to have relatively high absorption properties are conventionally known as acoustic absorbers.

In the past, porous acoustic absorbers have been utilized to absorb acoustic energy. At medium and high frequencies, most porous acoustic absorbers rely primarily on their porosity for absorbing acoustic energy, sound waves being converted into heat by viscous friction resulting from the propagation of the sound waves through openings in the acoustic absorber. However, at relatively low frequencies, the porous acoustic absorbers absorb acoustic energy primarily through mechanical dissipation occurring when the sound waves force the acoustic absorber into vibrating motion, the resulting flexural vibration converting a fraction of the incident acoustic energy into heat, the balance of the acoustic energy being absorbed by porous absorption. Heretofore, porous acoustic absorbers have never achieved sound absorption at both high and low frequencies through the use of a flexible material.

There is provided, in accordance with the present invention, a novel acoustic absorbing structure and method which utilize an acoustic absorber having a porosity designed to absorb sound over a wide range of frequencies. Broadly, the acoustic absorber includes a substrate having a plurality of openings therethrough and an organic polymer coating covering the substrate and partially filling the openings in the substrate in such a manner that the acoustic absorber has a resulting porosity not substantially greater than 60 CFM/ft$^2$, at ½ inch differential water pressure.

The acoustic absorber may be flexible, in which case it not only enhances sound absorption at low frequencies, but also facilitates shipping and installation, thereby reducing construction time and costs. For instance, its flexibility permits the acoustic absorber to be shipped as a roll.

The range of sound absorption may be further enhanced by providing the acoustic absorber with randomly sized openings, which provide a means for bracketing the ideal opening size. Although it is desirable to maintain the porosity across the acoustic absorber relatively constant, the shape and size of the openings may be varied depending on the frequency of the sound waves to be absorbed. It has been found that an acoustic absorber having openings with a cross-dimension less than 2.0 mils will absorb sound over a wide range of frequencies. The term "cross-dimension" as used herein means the diameter of a round opening, the minor or major axis of an elliptical opening, the minor or major medial axis of an irregular star-shaped opening, the width or length of a rectangular opening or the base or height of a triangular opening.

The substrate can be any inorganic or organic fabric capable of withstanding the fusion temperature of the organic polymer with which it is to be coated. Suitable substrates may be made of glass; fiberglass; asbestos; aramid fiber; nylon; long chain polyesters, such as Dacron; or wire cloth. The substrate may have a thickness of about 3 to 30 mils, a weight of about 3 to 25 oz/yd$^2$, and openings of such a size that they may be partially filled with any suitable organic polymer coating to form an acoustic absorber having a porosity not substantially greater than 60 CFM/ft$^2$, at ½ inch differential water pressure. It may be woven or non-woven fabric, or may be of a matted or print-out construction. If a woven fabric is used, a plurality of strands are woven together to form openings therebetween, the strands being substantially round or flat in radial cross-section. Presently available weaving equipment can produce a continuous piece of fabric having a width of about 12 feet.

Any organic polymer coating is suitable having the properties of known fabric coatings. These coatings render the substrate impervious to water, other liquids, or dust and dirt particles which would adversely affect the substrate in the absence of the coating. The coating also stabilizes the size of the openings in the acoustic absorber, since the flexing or bending of an uncoated substrate would vary the size of the openings therein, and hence the porosity of the acoustic absorber. While the composition of the coatings is not important as long as the coating can control the porosity of the substrate, suitable organic polymers which can be used to coat the substrate include fluorinated organic polymers and vinyl polymers. Acceptable fluorinated organic polymers include polytetrafluoroethylene, perfluoroalkoxy, polyvinylidenefluoride and fluorinated ethylenepropylene polymers; while acceptable vinyl polymers include polyvinylchloride.

In accordance with known methods, the substrate may be initially treated with silicone oil, as an interior layer in the final construction, to prevent the organic polymer coating from penetrating into the substrate. This optional pretreatment helps maintain the flexibility of the substrate and improves the trapezoidal tear strength of the acoustic absorber, as well as preventing any possible changes in porosity. A 33% solution of a silicone (e.g., polydimethyl siloxane) in xylene can be applied, followed by curing at 450° F. for about five minutes. The application can be made by doctor knife, doctor roller, reverse roll doctor, and any other known technique in the art of coating surfaces with liquid coating compositions. Besides silicone oil, the substrate can also be pre-treated with hydrocarbon oils or any other substance that keeps the substrate from getting wet.

If the substrate is fiberglass, it should be precleaned with heat to remove the sizing normally contained in glass fabrics, and thereafter treated with silicone oil as described above. This will help to prevent ultraviolet deterioration of the acoustic absorber.

In one embodiment, the acoustic absorber includes a porous, glass fabric substrate formed by weaving together a multiplicity of individual strands of fiberglass. The woven substrate is coated with an organic polymer coating in such a manner that the coating adheres to and completely covers each individual strand. The acoustic absorber has a weight of about 4 oz/yd$^2$ to about 31 oz/yd$^2$ and a thickness of about 4 mils to about 42 mils. Inasmuch as the acoustic absorber is thin and relatively light, it may be handled easily and installed with a minimum of hangers or other mountings.

In use, the acoustic absorber is supported adjacent and spaced from a structural surface, a distance sufficient to permit sound waves to pass through the acoustic absorber. The acoustic absorber should be mounted at least about 1½ inches from the structural surface. Optimally, the distance is a ¼ wavelength, the wavelength λ having the following relationship to frequency f, expressed in Hz:

$$\lambda = c/f,$$

where c is the speed of sound.

Because the acoustic absorber is thin, flexible, strong and relatively light, it can be installed in a number of unique ways without detracting from its sound absorbing capabilities. For instance, the acoustic absorber can be festooned, draped or hung like a banner from a ceiling or similar structural surface. It is also possible to hang the acoustic absorber horizontally below a ceiling. The acoustic absorber has such an attractive appearance and pleasant hand that it could even be pleated and hung from a curtain rod in place of a traditional curtain.

One unique method of installation, which has been quite successful in domed or enclosed stadiums, involves hanging a plurality of acoustic absorbing banners around the inner periphery of the stadium. In accordance with this method, each end of an acoustic absorbing banner may be attached to a corresponding rod, for example by providing transversely extending sleeves at each end for receiving the rods. One rod is attached to the stadium wall and the other rod is attached to the ceiling in such a manner that the banner extends upwardly at an angle from the wall to the ceiling. The length and width of each banner, as well as the number of banners employed, can be varied depending upon the stadium dimensions and the sound absorbing requirements. The acoustic absorbing banners are advantageously manufactured from a translucent fabric, so that they can be hung below lighting fixtures without appreciably blocking the transmission of light.

To use the invention in dropped ceiling installations, a piece of acoustic absorbing fabric is mounted on a frame, designed to fit between two pairs of brackets which usually form a 2′×2′ or 2′×4′ receptacle. Because it is moisture-proof, the acoustic absorbing fabric will not rot or mildew like the conventional acoustic ceiling tiles normally used in dropped ceiling installations. This also permits it to be spray-cleaned or washed with a liquid. Inasmuch as the fabric is fire resistant, it can be used safely in industrial kitchens and other areas where flames are exposed.

The following examples further illustrate the invention. To facilitate consideration and discussion of the examples, it should be explained that for a particular frequency band the sound absorption coefficient of a surface is, aside from the effects of diffraction, the fraction of randomyl incident sound energy absorbed or otherwise not reflected, measured in sabins per square foot. The noise reduction coefficient (NRC) can be calculated by averaging the sound absorption coefficients at 250, 500, 1000 and 2000 Hz, expressed to the nearest integral multiple of 0.05. An Acoustical and Insulating Materials Association (AIMA) No. 7 mounting positions the face of the test specimen 16 inches above the reverberation room floor. The sides of the mounting are enclosed with plywood so that sound can be transmitted only through the test specimen into the air space behind it.

EXAMPLE I

Plain weave glass fabric, Burlington #116, having a thickness of 3.5 mils and a weight of 3.20 oz/yd$^2$, with a yarn warp of 450½ and a yarn filling of 450½, woven to a warp and fill count of 60×58, was coated with polytetrafluoroethylene so that the openings in the fabric were partially filled. The coated fabric had a porosity of about 7 to 14 CFM/ft$^2$, at ½ inch differential water pressure, a thickness of about 4.0 mils, and a weight of about 4.0 oz/yd$^2$.

Microscopic examination reveals that the partially filled openings take on different shapes and sizes. For example, there are substantially round openings having a diameter of between 0.5 to 1.5 mils, substantially elliptical openings having a minor axis of about 0.5 mil and a major axis of about 1.5 mils, and irregular star-shaped openings having a minor medial axis of about 0.5 mil and a major medial axis of about 1.5 mils.

When the coated fabric was tested for sound absorption qualities in an AIMA No. 7 mounting, a NRC of 0.30 was obtained based on the following test results:

| SOUND ABSORPTION COEFFICIENTS (α) | | | | | | |
|---|---|---|---|---|---|---|
| 63 Hz | 125 Hz | 250 Hz | 500 Hz | 1000 Hz | 2000 Hz | 4000 Hz |
| — | .01 | .13 | .26 | .32 | .48 | .32 |

EXAMPLE II

Plain weave glass fabric, Burlington #116, having a thickness of 3.5 mils and a weight of 3.20 oz/yd$^2$, with a yarn warp of 450½ and a yarn filling of 450½, woven to a warp and fill count of 60×58, was coated with polytetrafluoroethylene so that the openings in the fabric were partially filled. The coated fabric had a porosity of about 24 to 35 CFM/ft$^2$, at ½ inch differential water pressure, a thickness of about 4.0 mils, and a weight of about 4.0 oz/yd$^2$.

Microscopic examination reveals that the partially filled openings take on different shapes and sizes. For example, there are substantially round openings having a diameter of between 0.5 and 3.0 mils, substantially elliptical openings having a minor axis of about 0.5 mil and a major axis of about 3.0 mils, and irregular star-shaped openings having a minor medial axis of about 0.5 mil and a major medial axis of about 3.0 mils.

When the coated fabric was tested for sound absorption qualities in an AIMA No. 7 mounting, a NRC of 0.33 was obtained based on the following test results:

| SOUND ABSORPTION COEFFICIENTS (α) | | | | | | |
|---|---|---|---|---|---|---|
| 63 Hz | 125 Hz | 250 Hz | 500 Hz | 1000 Hz | 2000 Hz | 4000 Hz |
| — | .18 | .34 | .27 | .37 | .33 | .41 |

EXAMPLE III

Plain weave glass fabric, Burlington #125, having a thickness of 5.0 mils and a weight of 3.75 oz/yd$^2$, with a yarn warp of 450 2/2 and a yarn filling of 450 2/2, woven to a warp and fill count of 36×34, was coated with polytetrafluoroethylene so that the openings in the fabric were partially filled. The coated fabric had a porosity of about 15 to 40 CFM/ft$^2$, at ½ inch differential water pressure, a thickness of about 6.0 to 7.0 mils, and a weight of about 5.35 oz/yd$^2$.

Microscopic examination reveals that the partially filled openings take on different shapes and sizes. For example, there are substantially round openings having a diameter of about 1.0 mil, substantially elliptical openings having a minor axis of about 1.0 mil and a major axis of about 10.0 mils, irregular star-shaped openings having a minor medial axis of about 1.0 mil and a major medial axis of about 10.0 mils, and generally rectangular openings having a width of about 1.0 mil and a length of about 10.0 mils.

When the coated fabric was tested for sound absorption qualities in an AIMA No. 7 mounting, a NRC of 0.45 was obtained based on the following test results:

| SOUND ABSORPTION COEFFICIENTS (α) | | | | | | |
|---|---|---|---|---|---|---|
| 63 Hz | 125 Hz | 250 Hz | 500 Hz | 1000 Hz | 2000 Hz | 4000 Hz |
| .16 | .22 | .38 | .44 | .48 | .48 | .50 |

EXAMPLE IV

Plain weave glass fabric, Burlington #125, having a thickness of 5.0 mils and a weight of 3.75 oz/yd$^2$, with yarn warp of 450 2/2 and a yarn filling of 450 2/2, woven to a warp and fill count of 36×34, was coated with polytetrafluoroethylene so that the openings in the fabric were partially filled. The coated fabric had a porosity of about 30 to 60 CFM/ft$^2$, at ½ inch differential water pressure, a thickness of about 5.8 mils, and a weight of about 4.9 oz/yd$^2$.

Microscopic examination reveals that the partially filled openings take on different shapes and sizes. For example, there are substantially round openings having a diameter of about 1.5 mils, substantially elliptical openings having a minor axis of about 1.5 mils and a major axis of about 10.0 mils, irregular star-shaped openings having a minor medial axis of about 1.5 mils and a major medial axis of about 10.0 mils, and generally rectangular openings having a width of about 1.5 mils and a length of about 10.0 mils.

When the coated fabric was tested for sound absorption qualities in an AIMA No. 7 mounting, a NRC of 0.38 was obtained based on the following test results:

| SOUND ABSORPTION COEFFICIENTS (α) | | | | | | |
|---|---|---|---|---|---|---|
| 63 Hz | 125 Hz | 250 Hz | 500 Hz | 1000 Hz | 2000 Hz | 4000 Hz |
| — | .17 | .39 | .24 | .46 | .42 | .46 |

EXAMPLE V

Plain weave glass fabric, Burlington #128, having a thickness of 6.5 mils and a weight of 6.00 oz/yd$^2$, with a yarn warp of 225⅓ and a yarn filling of 225⅓, woven to a warp and fill count of 42×32, was coated with polytetrafluoroethylene so that the openings in the fabric were partially filled. The coated fabric had a porosity of about 15 to 19 CFM/ft$^2$, at ½ inch differential water pressure, a thickness of about 7.5 mils, and a weight of about 7.2 oz/yd$^2$.

Microscopic examination reveals that the partially filled openings take on different shapes and sizes. For example, there are substantially round openings having a diameter of about 1.0 mils, substantially elliptical openings having a minor axis of about 2.0 mils and a major axis of about 5.0 mils, irregular star-shaped openings having a minor medial axis of about 2.0 mils and a major medial axis of about 5.0 mils, and generally rectangular openings having a width of about 2.0 mils and a length of about 5.0 mils.

When the coated fabric was tested for sound absorption qualities in an AIMA No. 7 mounting, a NRC of 0.51 was obtained based on the following test results:

| SOUND ABSORPTION COEFFICIENTS (α) | | | | | | |
|---|---|---|---|---|---|---|
| 63 Hz | 125 Hz | 250 Hz | 500 Hz | 1000 Hz | 2000 Hz | 4000 Hz |
| .14 | .16 | .44 | .41 | .59 | .58 | .51 |

EXAMPLE VI

Plain weave glass fabric, Burlington #128, having a thickness of 6.5 mils and a weight of 6.00 oz/yd$^2$, with a yarn warp of 225⅓ and a yarn filling of 225⅓, woven to a warp and fill count of 42×32, was coated with polytetrafluoroethylene so that the openings in the fabric were partially filled. The coated fabric has a porosity of about 20 to 40 CFM/ft$^2$, at ½ inch differential water pressure, a thickness of about 7.5 mils, and a weight of about 7.2 oz/yd$^2$.

Microscopic examination reveals that the partially filled openings take on different shapes and sizes. For example, there are substantially round openings having a diameter of about 2.0 mils, substantially elliptical openings having a minor axis of about 2.0 mils and a major axis of about 10.0 mils, irregular star-shaped openings having a minor medial axis of about 2.0 mils and a major medial axis of about 10.0 mils, and generally rectangular openings having a width of about 2.0 mils and a length of about 10.0 mils.

When the coated fabric was tested for sound absorption qualities in an AIMA No. 7 mounting, a NRC of 0.42 was obtained based on the following test results:

| SOUND ABSORPTION COEFFICIENTS (α) | | | | | | |
|---|---|---|---|---|---|---|
| 63 Hz | 125 Hz | 250 Hz | 500 Hz | 1000 Hz | 2000 Hz | 4000 Hz |
| — | .36 | .42 | .33 | .55 | .36 | .47 |

EXAMPLE VII

Plain weave glass fabric, Burlington #128, having a thickness of 6.5 mils and a weight of 6.00 oz/yd$^2$, with a yarn warp of 225⅓ and a yarn filling of 225⅓, woven to a warp and fill count of 42×32, was coated with polytetrafluoroethylene so that the openings in the fabric were partially filled. The coated fabric had a porosity of about 60 to 80 CFM/ft$^2$, at ½ inch differential water pressure, a thickness of about 7.5 mils, and a weight of about 7.2 oz/yd$^2$.

Microscopic examination reveals that the partially filled openings take on different shapes and sizes. For example, there are substantially round openings having a diameter of about 2.0 mils, substantially elliptical openings having a minor axis of about 2.0 mils and a major axis of about 10.0 mils, irregular star-shaped openings having a minor medial axis of about 2.0 mils and a major medial axis of about 10.0 mils, and generally rectangular openings having a width of about 2.0 mils and a length of about 10.0 mils.

When the coated fabric was tested for sound absorption qualities in an AIMA No. 7 mounting, a NRC of 0.26 was obtained based on the following test results:

| SOUND ABSORPTION COEFFICIENTS (α) | | | | | | |
|---|---|---|---|---|---|---|
| 63 Hz | 125 Hz | 250 Hz | 500 Hz | 1000 Hz | 2000 Hz | 4000 Hz |
| .21 | .23 | .21 | .28 | .27 | .28 | .24 |

EXAMPLE VIII

Plain weave glass fabric, Burlington #1528, having a thickness of 6.5 mils and a weight of 5.95 oz/yd$^2$, with a yarn warp of 150½ and a yarn filling of 150½, woven to a warp and fill count of 42×32, was coated with polytetrafluoroethylene so that the openings in the fabric were partially filled. The coated fabric had a porosity of about 8 to 11 CFM/ft$^2$, at ½ inch differential water pressure, a thickness of about 7.5 mils, and a weight of about 7.2 oz/yd$^2$.

Microscopic examination reveals that the partially filled openings take on different shapes and sizes. For example, there are substantially round openings having a diameter of about 0.5 mil, substantially elliptical openings having a minor axis of about 0.5 mil and a major axis of about 3.0 mils, irregular star-shaped openings having a minor medial axis of about 0.5 mil and a major medial axis of about 3.0 mils, and generally rectangular openings having a width of about 0.5 mil and a length of about 3.0 mils.

When the coated fabric was tested for sound absorption qualities in an AIMA No. 7 mounting, a NRC of 0.45 was obtained based on the following test results:

| SOUND ABSORPTION COEFFICIENTS (α) | | | | | | |
|---|---|---|---|---|---|---|
| 63 Hz | 125 Hz | 250 Hz | 500 Hz | 1000 Hz | 2000 Hz | 4000 Hz |
| .68 | .26 | .42 | .33 | .50 | .53 | .55 |

EXAMPLE IX

Plain weave glass fabric, Burlington #1142, having a thickness of 10.0 mils and a weight of 8.25 oz/yd$^2$, with a yarn warp of 37 1/0 and a yarn filling of 37 1/0, woven to a warp and fill count of 32×21, was coated with polytetrafluoroethylene so that the openings in the fabric were partially filled. The coated fabric had a porosity of about 15 to 20 CFM/ft$^2$, and ½ inch differential water pressure, a thickness of about 10.5 mils, and a weight of about 9.5 oz/yd$^2$.

Microscopic examination reveals that the partially filled openings take on different shapes and sizes. For example, there are substantially round openings having a diameter of about 2.0 mils, substantially elliptical openings having a minor axis of about 2.0 mils and a major axis of about 15.0 mils, irregular star-shaped openings having a minor medial axis of about 2.0 mils and a major medial axis of about 15.0 mils, and generally rectangular openings having a width of about 2.0 mils and a length of about 15.0 mils.

When the coated fabric was tested for sound absorption qualities in an AIMA No. 7 mounting, a NRC of 0.66 was obtained based on the following test results:

| SOUND ABSORPTION COEFFICIENTS (α) | | | | | | |
|---|---|---|---|---|---|---|
| 63 Hz | 125 Hz | 250 Hz | 500 Hz | 1000 Hz | 2000 Hz | 4000 Hz |
| — | .60 | .69 | .54 | .70 | .72 | .75 |

EXAMPLE X

Plain weave glass fabric, Burlington #141, having a thickness of 11.0 mils and a weight of 8.80 oz/yd$^2$, with a yarn warp of 225 3/2 and a yarn filling of 225 3/2, woven to a warp and fill count of 32×21, was coated with polytetrafluoroethylene so that the openings in the fabric were partially filled. The coated fabric had a porosity of about 20 to 40 CFM/ft$^2$, at ½ inch differential water pressure, a thickness of about 12.5 mils, and a weight of about 11.5 oz/yd$^2$.

Microscopic examination reveals that the partially filled openings take on different shapes and sizes. For example, there are substantially round openings having a diameter of about 2.0 mils, substantially elliptical openings having a minor axis of about 2.0 mils and a major axis of about 15.0 mils, irregular star-shaped openings having a minor medial axis of about 2.0 mils and a major medial axis of about 15.0 mils, and generally rectangular openings having a width of about 2.0 mils and a length of about 15.0 mils.

When the coated fabric was tested for sound absorption qualities in an AIMA No. 7 mounting, a NRC of 0.66 was obtained based on the following test results:

| SOUND ABSORPTION COEFFICIENTS (α) | | | | | | |
|---|---|---|---|---|---|---|
| 63 Hz | 125 Hz | 250 Hz | 500 Hz | 1000 Hz | 2000 Hz | 4000 Hz |
| .83 | .44 | .73 | .53 | .70 | .66 | .65 |

EXAMPLE XI

Plain weave glass fabric, Burlington #141, having a thickness of 11.0 mils and a weight of 8.80 oz/yd$^2$, with a yarn warp of 225 3/2 and a yarn filling of 225 3/2, woven to a warp and fill count of 32×21, was coated with polytetrafluoroethylene so that the openings in the fabric were partially filled. The coated fabric had a porosity of about 40 to 60 CFM/ft$^2$, at ½ inch differential water pressure, a thickness of about 12.5 mils, and a weight of about 10.8 oz/yd$^2$.

Microscopic examination reveals that the partially filled openings take on different shapes and sizes. For example, there are substantially round openings having a diameter of about 2.0 mils, substantially elliptical openings having a minor axis of about 2.0 mils and a major axis of about 20.0 mils, irregular star-shaped openings having a minor medial axis of about 2.0 mils and a major medial axis of about 20.0 mils, and generally rectangular openings having a width of about 2.0 mils and a length of about 20.0 mils.

When the coated fabric was tested for sound absorption qualities in an AIMA No. 7 mounting, a NRC of 0.52 was obtained based on the following test results:

| SOUND ABSORPTION COEFFICIENTS (α) | | | | | | |
|---|---|---|---|---|---|---|
| 63 Hz | 125 Hz | 250 Hz | 500 Hz | 1000 Hz | 2000 Hz | 4000 Hz |
| .35 | .38 | .73 | .42 | .48 | .46 | .46 |

EXAMPLE XII

Plain weave glass fabric, Burlington #141, having a thickness of 11.0 mils and a weight of 8.80 oz/yd$^2$, with a yarn warp of 225 3/2 and a yarn filling of 225 3/2, woven to a warp and fill count of 32×21, was coated with polytetrafluoroethylene so that the openings in the fabric were partially filled. The coated fabric had a porosity of about 80 to 110 CFM/ft$^2$, at ½ inch differential water pressure, a thickness of about 12.5 mils, and a weight of about 10.0 oz/yd$^2$.

Microscopic examination reveals that the partially filled openings take on different shapes and sizes. For example, there are substantially round openings having a diameter of about 2.0 mils, substantially elliptical openings having a minor axis of about 2.0 mils and a major axis of about 20.0 mils, irregular star-shaped openings having a minor medial axis of about 2.0 mils and a major medial axis of about 20.0 mils, and generally rectangular openings having a width of about 2.0 mils and a length of about 20.0 mils.

When the coated fabric was tested for sound absorption qualities in an AIMA No. 7 mounting, a NRC of 0.27 was obtained based on the following test results:

| SOUND ABSORPTION COEFFICIENTS (α) | | | | | | |
|---|---|---|---|---|---|---|
| 63 Hz | 125 Hz | 250 Hz | 500 Hz | 1000 Hz | 2000 Hz | 4000 Hz |
| .10 | .23 | .36 | .26 | .18 | .26 | .28 |

EXAMPLE XIII

Eight harness satin weave glass fabric, Burlington #183, having a thickness of 6.0 mils and a weight of 16.75 oz/yd$^2$, with a yarn warp of 225 3/2 and a yarn filling of 225 3/2, woven to a warp and fill count of 54×48, was coated with polytetrafluoroethylene so that the openings in the fabric were partially filled. The coated fabric had a porosity of about 15 CFM/ft$^2$, at ½ inch differential water pressure, substantially round openings having a diameter of about 2.0 to 5.0 mils, a thickness of about 25.0 mils, and a weight of about 20.5 oz/yd$^2$.

When the coated fabric was tested for sound absorption qualities in an AIMA No. 7 mounting, a NRC of 0.54 was obtained based on the following test results:

| SOUND ABSORPTION COEFFICIENTS (α) | | | | | | |
|---|---|---|---|---|---|---|
| 63 Hz | 125 Hz | 250 Hz | 500 Hz | 1000 Hz | 2000 Hz | 4000 Hz |
| .73 | .58 | .51 | .54 | .51 | .61 | .44 |

EXAMPLE XIV

Eight harness satin weave fabric, Burlington #183, having a thickness of 6.0 mils and a weight of 16.75 oz/yd$^2$, with a yarn warp of 225 3/2 and a yarn filling of 225 3/2, woven to a warp and fill count of 54×48, was coated with polytetrafluoroethylene so that the openings in the fabric were partially filled. The coated fabric had a porosity of about 30 CFM/ft$^2$, at ½ inch differential water pressure, substantially round openings having a diameter of about 2.0 to 5.0 mils, a thickness of about 25.0 mils, and a weight of about 20.0 oz/yd$^2$.

When the coated fabric was tested for sound absorption qualities in an AIMA No. 7 mounting, a NRC of 0.59 was obtained based on the following test results:

| SOUND ABSORPTION COEFFICIENTS (α) | | | | | | |
|---|---|---|---|---|---|---|
| 63 Hz | 125 Hz | 250 Hz | 500 Hz | 1000 Hz | 2000 Hz | 4000 Hz |
| .40 | .41 | .58 | .58 | .55 | .65 | .59 |

EXAMPLE XV

Eight harness satin weave glass fabric, Burlington, #1584, having a thickness of 25.5 mils and a weight of 25.15 oz/yd$^2$, with a yarn warp of 150 4/2 and a yarn filling of 150 4/2, woven to a warp and fill count of 42×35, was coated with polytetrafluoroethylene so that openings in the fabric were partially filled. The coated fabric had a porosity of about 30–40 CFM/ft$^2$, at ½ inch differential water pressure, substantilly triangular openings having a base of about 0.5 mil and a height of about 1.0 mil, a thickness of about 42.0 mils, and a weight of about 30.5 oz/yd$^2$.

When the coated fabric was tested for sound absorption qualities in an AIMA No. 7 mounting, a NRC of 0.44 was obtained based on the following test results:

| SOUND ABSORPTION COEFFICIENTS (α) | | | | | | |
|---|---|---|---|---|---|---|
| 63 Hz | 125 Hz | 250 Hz | 500 Hz | 1000 Hz | 2000 Hz | 4000 Hz |
| .71 | .50 | .44 | .52 | .40 | .41 | .44 |

EXAMPLE XVI

Eight harness satin weave fabric, Burlington #1584, having a thickness of 25.5 mils and a weight of 25.15 oz/yd$^2$, with a yarn warp of 150 4/2 and a yarn filling of 150 4/2, woven to a warp and fill count of 42×35, was coated with polytetrafluoroethylene so that the openings in the fabric were partially filled. The coated fabric had a porosity of about 40 to 50 CFM/ft$^2$, at ½ inch differential water pressure, substantially triangular openings having a base of about 1.0 mil and a height of about 3.0 mils, a thickness of about 42.0 mils, and a weight of about 31.0 oz/yd$^2$.

When the coated fabric was tested for sound absorption qualities in an AIMA No. 7 mounting, a NRC of 0.59 was obtained based on the following test results:

| SOUND ABSORPTION COEFFICIENTS (α) | | | | | | |
|---|---|---|---|---|---|---|
| 63 Hz | 125 Hz | 250 Hz | 500 Hz | 1000 Hz | 2000 Hz | 4000 Hz |
| — | .94 | .62 | .55 | .65 | .53 | .57 |

EXAMPLE XVII

Plain weave glass fabric, Burlington #1142, having a thickness of 10.0 mils and a weight of 8.25 oz/yd$^2$, with a yarn warp of 37 1/0 and a yarn filling of 37 1/0, woven to a warp and fill count of 32×21, was coated with polytetrafluoroethylene so that the openings in the fabric were partially filled. The coated fabric had a porosity of less than 10 CFM/ft$^2$, at ½ inch differential water pressure, a thickness of about 12.0 mils, and a weight of about 11.0 oz/yd$^2$.

Microscopic examination reveals that the partially filled openings take on different shapes and sizes. For example, there are substantially round openings having a diameter of between 1.0 to 3.0 mils substantially elliptical openings having a minor axis of about 1.0 mil and a major axis of about 6.0 mils, and irregular star-shaped openings having a minor medial axis of about 1.0 mil and a major medial axis of about 6.0 mils.

When the coated fabric was tested for sound absorption qualities in an AIMA No. 7 mounting, a NRC of 0.67 obtained based on the following test results:

| SOUND ABSORPTION COEFFICIENTS (α) | | | | | | |
|---|---|---|---|---|---|---|
| 63 Hz | 125 Hz | 250 Hz | 500 Hz | 1000 Hz | 2000 Hz | 4000 Hz |
| — | .56 | .63 | .53 | .83 | .67 | .17 |

A review of the preceding examples indicates that better sound absorption qualities, i.e., NRC values between 0.30 and 0.66, are obtained when the porosity of the acoustic absorbers is about 60 CFM/ft$^2$ or less. If the porosity increases substantially above 60 CFM/ft$^2$, i.e., Examples VII and XII, the sound absorption qualities of the acoustic absorbers diminish.

It will be understood that the described embodiments are merely exemplary and that persons skilled in the art may make many variations and modifications without departing from the spirit and scope of the invention. For example, the sound absorbing properties of the acoustic absorber may be controlled by varying the thickness and weight of the acoustic absorber, as well as its porosity and weave characteristics. The acoustic absorber of the present invention may also be used for attenuating sound in longitudinal sound paths (e.g., air conditioning ducts, corridors, and exhaust pipes) by being spacedly positioned therein so that sound waves are attenuated as they propagate down the sound paths. All such modifications and variations are intended to be included within the scope of the invention as defined in the appended claims.

What is claimed is:

1. In an acoustic absorber, including a porous substrate, having a multiplicity of openings extending through the substrate, and an organic polymer applied to the substrate, the improvement wherein the organic polymer completely covers the surfaces of the substrate on both sides thereof and partially fills at least some of the openings extending through the substrate in such a manner that the acoustic absorber has a porosity not substantially greater than 60 CFM/ft$^2$, at $\frac{1}{2}$ inch differential water pressure; and wherein the acoustic absorber is flexible.

2. An acoustic absorber according to claim 1, wherein the substrate is a woven fiberglass fabric.

3. An acoustic absorber according to claim 1, wherein a majority of the openings have a cross-dimension substantially less than 2 mils.

4. An acoustic absorber according to claim 1, wherein the acoustic absorber has a weight not substantially less than 4 oz/yd$^2$ and not substantially greater than 31 oz/yd$^2$.

5. An acoustic absorber according to claim 1, wherein the acoustic absorber has a thickness not substantially less than 4 mils and not substantially greater than 42 mils.

6. An acoustic absorber according to claim 1, wherein the openings in the acoustic absorber are randomly sized.

7. An acoustic absorber, comprising a multiplicity of individual strands of fiberglass woven together to form a porous, glass fabric substrate; and a fluorinated organic polymer coating adhering to and completely covering each individual strand and partially filling openings in the substrate, the acoustic absorber having a porosity not substantially greater than 60 CFM/ft$^2$, at $\frac{1}{2}$ inch differential water pressure, a flexibility capable of absorbing sound waves of relatively low frequencies by mechanical dissipation caused when relatively low frequency sound waves force the acoustic absorber into vibrating motion and numerous randomly sized and shaped openings capable of absorbing sound waves of relatively high frequencies by viscous friction caused when relatively high frequency sound waves pass through the openings, whereby acoustic energy may be absorbed over a wide range of frequencies.

8. An acoustic absorber according to claim 1, wherein the organic polymer coating is a fluorinated organic polymer.

9. An acoustic absorber according to claim 8, wherein the fluorinated organic polymer is selected from the group consisting of polytetrafluoroethylene, fluorinated ethylenepropylene polymers, perfluoroalkoxy and polyvinylidenefluoride.

10. An acoustic absorber according to claim 1, wherein the organic polymer coating is a vinyl polymer.

11. A method for absorbing sound waves in a structure, comprising positioning a flexible acoustic absorber including a porous substrate, having a multiplicity of openings extending through the substrate, and an organic polymer coating applied to and covering both sides of the substrate and partially filling at least some of the openings extending through the substrate in such a manner that the acoustic absorber has a porosity not substantially greater than 60 CFM/ft$^2$, at $\frac{1}{2}$ inch differential water pressure, the acoustic absorber being adjacent and spaced from a surface of the structure a distance sufficient to permit sound waves to pass through the acoustic absorber.

* * * * *